US008464479B2

(12) United States Patent
Guirgis

(10) Patent No.: US 8,464,479 B2
(45) **Date of Patent: *Jun. 18, 2013**

(54) STRUCTURAL SYSTEM WITH HIGH ABSORPTION CAPACITY TO IMPACTIVE AND IMPULSIVE LOADS

(76) Inventor: Sameh Guirgis, Montréal (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/926,935

(22) Filed: Dec. 17, 2010

(65) Prior Publication Data

US 2012/0005974 A1 Jan. 12, 2012

Related U.S. Application Data

(60) Continuation of application No. 12/458,427, filed on Jul. 10, 2009, now Pat. No. 7,895,798, which is a division of application No. 11/360,434, filed on Feb. 24, 2006, now Pat. No. 7,578,103.

(51) Int. Cl.
*E06B 3/32* (2006.01)

(52) U.S. Cl.
USPC ..... 52/202; 52/203; 52/235; 52/783.13; 89/36.01; 109/49.5; 109/78; 109/80; 109/81

(58) Field of Classification Search
USPC ..... 109/49.5, 80–85, 78; 89/36.02, 36.04, 89/36.15; 52/202, 202.783, 783.1, 794.1, 52/DIG. 12, 67
See application file for complete search history.

(56) References Cited

U.S. PATENT DOCUMENTS

| | | | | | |
|---|---|---|---|---|---|
| 2,076,388 | A * | 4/1937 | Venzie | 52/393 |
| 3,508,747 | A * | 4/1970 | Orsatti | 473/499 |
| 4,109,430 | A * | 8/1978 | Fuller | 52/127.7 |
| 4,248,018 | A * | 2/1981 | Casamayor | 49/504 |
| 4,590,721 | A * | 5/1986 | Berg et al. | 52/169.1 |
| 4,922,666 | A * | 5/1990 | Rotter et al. | 52/66 |
| 4,928,468 | A * | 5/1990 | Phillips | 52/574 |
| 4,986,037 | A * | 1/1991 | Jackson, Jr. | 52/67 |
| 5,115,610 | A * | 5/1992 | Kessler | 52/204.591 |
| 5,154,019 | A * | 10/1992 | Day | 49/504 |
| 5,154,469 | A * | 10/1992 | Morrow | 296/26.02 |
| 5,228,257 | A * | 7/1993 | Bowersox et al. | 52/588.1 |
| 6,108,983 | A * | 8/2000 | Dewald et al. | 52/67 |
| 6,152,520 | A * | 11/2000 | Gardner | 296/175 |
| 6,182,401 | B1 * | 2/2001 | McManus et al. | 52/67 |
| 6,333,085 | B1 * | 12/2001 | Emek | 428/34 |
| 6,818,268 | B2 * | 11/2004 | Gonzalez | 428/34 |
| 7,159,261 | B2 * | 1/2007 | Carrigan | 14/71.1 |
| 7,225,717 | B2 * | 6/2007 | Williams | 89/36.08 |
| 7,383,600 | B2 * | 6/2008 | Carrigan | 14/71.1 |
| 7,520,207 | B1 * | 4/2009 | Fuqua et al. | 89/36.07 |
| 7,886,651 | B2 * | 2/2011 | Hall | 89/36.02 |
| 2002/0078634 | A1 * | 6/2002 | McManus et al. | 52/67 |
| 2004/0118271 | A1 * | 6/2004 | Puckett et al. | 89/36.02 |
| 2004/0187397 | A1 * | 9/2004 | Chapus | 52/67 |

(Continued)

*Primary Examiner* — Joshua J Michener
*Assistant Examiner* — Alp Akbasli

(57) ABSTRACT

A structural system that is capable of absorbing high impactive and impulsive loads comprises of the following elements:

(a) Main Structure: should be one of certain types of structures such as: containments, reservoirs, tanks, storages, etc.

(b) Outer Shield: an outside hardened structure fixed by an anchorage system and resting on a sliding-plane.

(c) Anchorage System: a set of anchors that hold the outer shield in place and collapses if the impactive or impulsive load exceeds certain level allowing the outer shield to slide crushing the filling layer and absorbing substantial amount of energy.

8 Claims, 5 Drawing Sheets

U.S. PATENT DOCUMENTS

| | | | | |
|---|---|---|---|---|
| 2005/0022658 | A1* | 2/2005 | Bateman et al. | 89/36.01 |
| 2005/0257677 | A1* | 11/2005 | Ravid et al. | 89/36.02 |
| 2005/0262998 | A1* | 12/2005 | Ahmad | 89/36.02 |
| 2005/0262999 | A1* | 12/2005 | Tomczyk et al. | 89/36.02 |
| 2006/0006023 | A1* | 1/2006 | Lim | 182/127 |
| 2008/0006146 | A1* | 1/2008 | Magnusson et al. | 89/36.02 |
| 2008/0047418 | A1* | 2/2008 | Warren et al. | 89/36.02 |
| 2008/0092730 | A1* | 4/2008 | Hall | 89/36.04 |
| 2008/0092731 | A1* | 4/2008 | Hall | 89/36.04 |
| 2008/0257137 | A1* | 10/2008 | James | 86/50 |
| 2009/0126557 | A1* | 5/2009 | Hunn | 89/36.02 |

* cited by examiner

STRUCTURAL SYSTEM WITH HIGH ABSORPTION CAPACITY TO IMPACTIVE AND IMPULSIVE LOADS

RELATED APPLICATIONS

This application is a continuation of application Ser. No. 12/458,427 filed on Jul. 10, 2009 now U.S. Pat. No. 7,895,798 which is a divisional of Ser. No. 11/360,434, filed on Feb. 24, 2006, now U.S. Pat. No. 7,578,103 issued Aug. 25, 2009.

BACKGROUND OF THE INVENTION

Some structures are designed with a higher than usual level of safety against partial or complete failure due to their functions and the disastrous consequences of their structural disintegration. However, many of such structures have been designed and built without considering some of the very high impactive or impulsive loads on the assumption that the probabilities of occurrence of such loads are extremely low. As time elapses, the changing circumstances of the world may render this probabilistic assessment obsolete and the probabilities of occurrence of such hazards become non-negligible. As an example of having structures subjected to unexpected hazards is the terrorist attack of Sep. 11, 2001, where three aircrafts crashed upon the two towers of the World Trade Center and the Pentagon building in the United States of America. Many other important structures such as: nuclear reactor containments, nuclear waste storages, large oil or natural gas reservoirs, large chemical containers, ammunition storages and military installations, could be threatened in the future by similar attacks or by accidents or in case of war.

Many of such hardened and rigid structures have reinforced concrete outside walls that may—in some buildings—exceed 2.0 meters in thickness. However, the thickness is usually less when the wall is made of pre-stressed concrete. It is also common to have the structure lined with a layer of steel or a non-metallic material. Moreover, reinforced concrete structures which are partially or completely buried under compacted layers of soil are common, especially, in military installations. Furthermore, it is also a common concept of design to have a cluster of buildings where the building which is required to be the most protected is surrounded by the others.

The common character of most of the above mentioned concepts is the very high rigidity of the outside walls of the structure, which represents a strong shield that is hard to penetrate by hard or soft missiles. However, the challenges represented by a crash of a large civilian air craft or a smart missile which could penetrate thick walls of reinforced concrete, require innovative designs that offer more protection for such important structures and to increase their capabilities to withstand very high impactive and impulsive loads.

SUMMARY OF THE INVENTION

This present invention is based on a novel approach that allows some types of structures to absorb very high energy, which could be generated by soft or hard missiles or by other types of impactive and impulsive loads. In this invention, the main structure is protected by a movable outer shield where the main structure and the movable outer shield are spaced apart and the space between them is filled with a selected crushable filling material. Moreover, the outer shield is initially fixed by an anchorage system; however, if the load exceeds certain limit, the anchorage system collapses and the outer shield becomes unconstrained and—under the effect of the load—undergoes free body motion crushing the filling material and absorbing very high energy.

The following remarks should be considered in regard of this structural system:

1. If the load is less than a certain value, then the outer shield should undergo limited small displacements, causing some strains in the filling layer. This represents the first level of load resistance, which should be sufficient to withstand impactive and impulsive loads and some other types of loads as well; such as tornadoes and earthquakes up to a certain value.
2. If the load exceeds that value, then the anchorage system should collapse allowing the outer shield to have a rigid body motion by sliding against the sliding-plane and crushing the filling layer, which should absorb a substantial amount of energy. This represents the second level of load resistance. As the shield reaches the maximum possible displacement, a missile—if one is the source of the load—should face three barriers represented by the outer shield, the crushed and compacted filling layer, and finally the wall of the main structure. These three elements can resist an additional and substantial impact force, while the missile's kinetic energy would have been substantially reduced. The collective resistance of these elements represents the third level of load resistance.
3. The possibility of perforating the main structure of this structural system or causing a loss of air tightness to it by a hard missile is considerably lower than it is for other systems due to several reasons:
   A. Allowing the outer shield to undergo large displacements substantially reduces the extremely high force generated by the impact of two rigid bodies.
   B. Creating discontinuities in the impacted structure by having three different layers, which prevents the propagation of stress waves.
   C. Reducing the possibilities of spalling and scabbing of concrete at the impacted area of the main structure. These phenomena should occur in reinforced concrete walls—even the very thick ones—when impacted by a hard missile.
   D. Absorbing a substantial amount of the kinetic energy of the hard missile by perforating the outer shield and crushing the filling material before the missile could hit the main structure.
4. In this structural system, the impact force could be resisted by having the anchors and the filling material on the side of the impact subjected to compressive stresses and by having the anchors and the filling material on the opposite side of the impact subjected to tensile stresses. This is an advantage over ordinary structural systems where the load is applied only on the impacted side.
5. Part of the energy of the load is dissipated in the friction generated during the sliding motion of the outer shield under its own weight and any vertical downward force component of the load.
6. The elevation of the sliding-plane should be determined based on the circumstances of each structure including the level of protection provided by the surrounding buildings, the location of the structure, its size, the limit of the outer shield weight. It is possible to have the sliding-plane little above the foundation level of the main structure or at the base level in case of—for instance—an elevated tank. Moreover, it could be possible in some structures to have more than one sliding-plane in the outer shield.
7. Having the crushable layer made of a fire resisting material and adding thin layers made of another fire-resisting material between the crushable layer and the main structure should provide effective fire protection to the structure. This protection is particularly important if the load is due to a crash or explosion which is—in most cases—followed by a fire.

8. This structural system could be used in constructing new structures or in fortifying existing structures as well. In the latter case, the existing structure should be considered as the main structure of the system. The system could also be used for structures with different shapes and sizes.
9. This structural system provides protection to its main structure from extreme weather conditions and large cyclic seasonal temperature variation. This protection maybe necessary in case of an existing structure that has considerable cracking. Moreover, this system could be used to substitute an existing structure for the partial loss of pre-stressing if it is an aging pre-stressed concrete structure.
10. It is possible to design the crushable layer so that it could be used during construction as formwork for a reinforced concrete outer shield which could significantly reduce the construction cost. Moreover, the outer shield could be made of reinforced concrete, steel or any other suitable material.

DESCRIPTION OF THE INVENTION

The current invention is related to a structural system that could withstand severe loading conditions, especially, high impactive and impulsive loads which may result from blast pressure, tornado-generated missiles, aircraft strike, and other sources.

Figure 1:
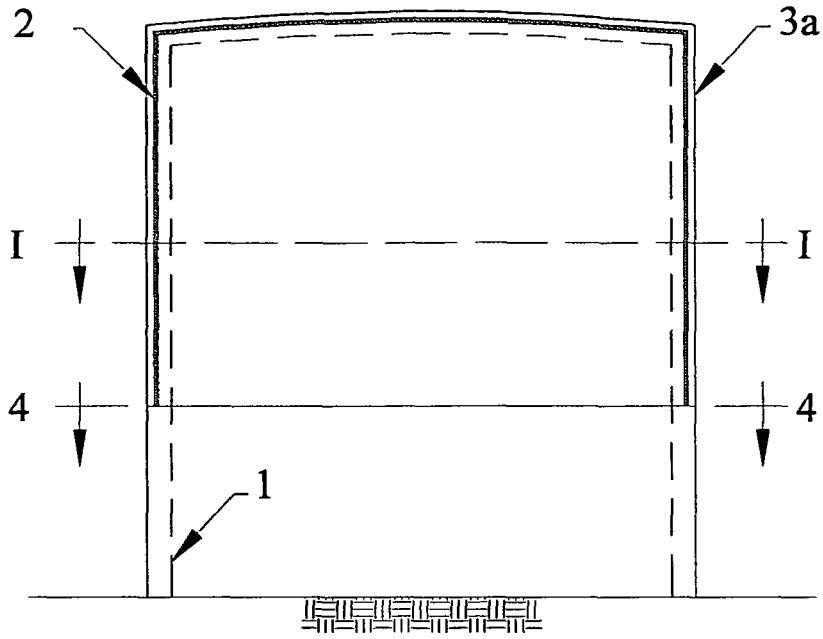
FIG. 1 shows the structural system, where 1 is the main structure, 2 is the crushable layer, 3*a* is the movable part of the outer shield, and 4-4 is the sliding-plane.
Figure 2:
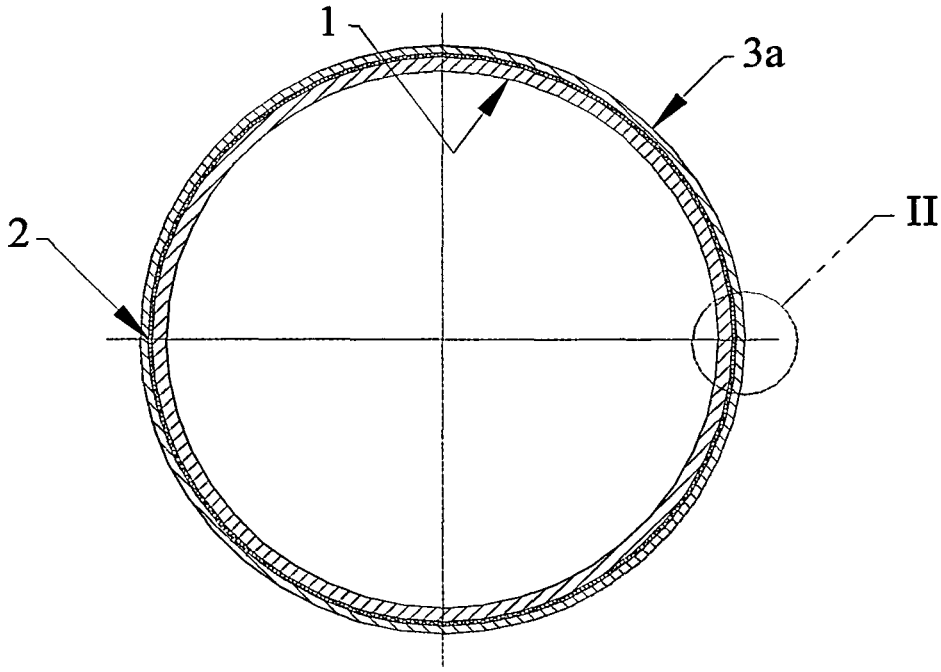
FIG. 2 is a cross-sectional view taken along line I-I of FIG. 1 assuming that the main structure is cylindrical in shape.
Figure 3:
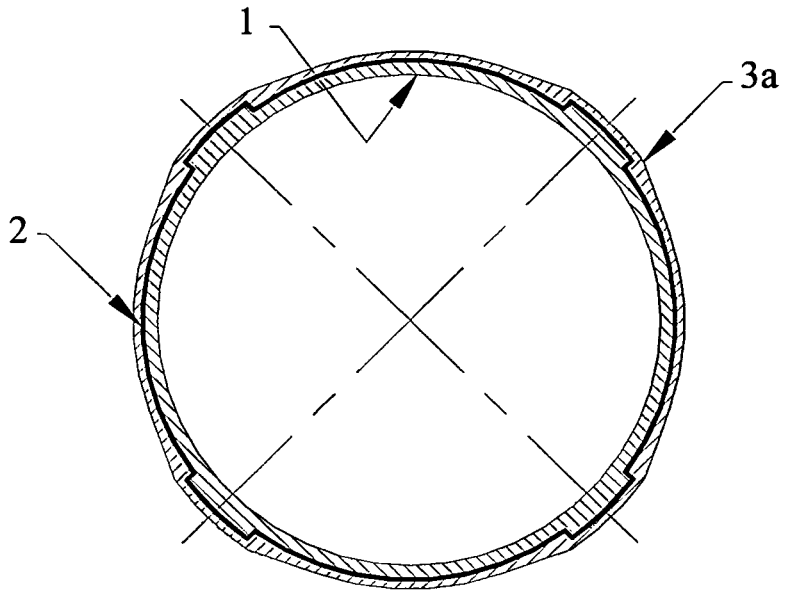
FIG. 3 is a cross-sectional view taken along line I-I of FIG. 1 assuming that the main structure is cylindrical in shape and is provided with four counterforts.
Figure 4:
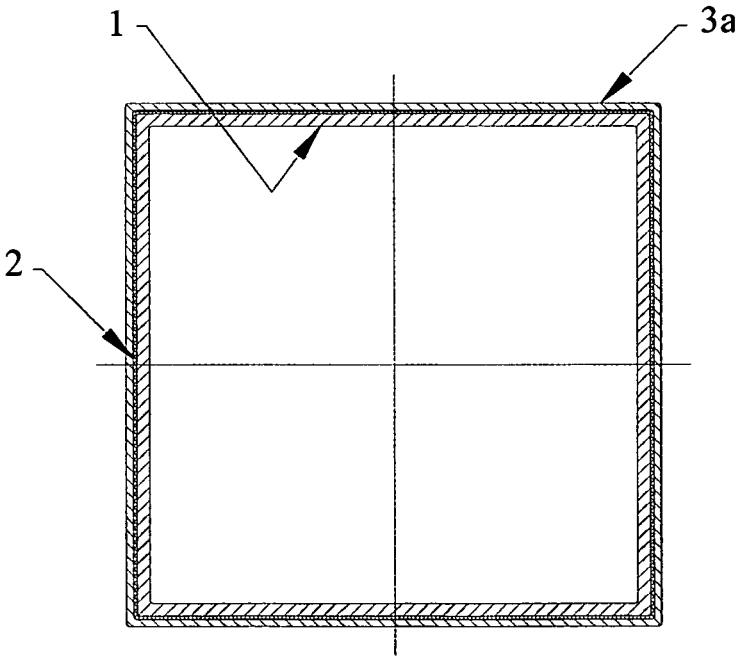
FIG. 4 is a cross-sectional view taken along line I-I of FIG. 1 assuming that the main structure is cubic in shape.
Figure 5:
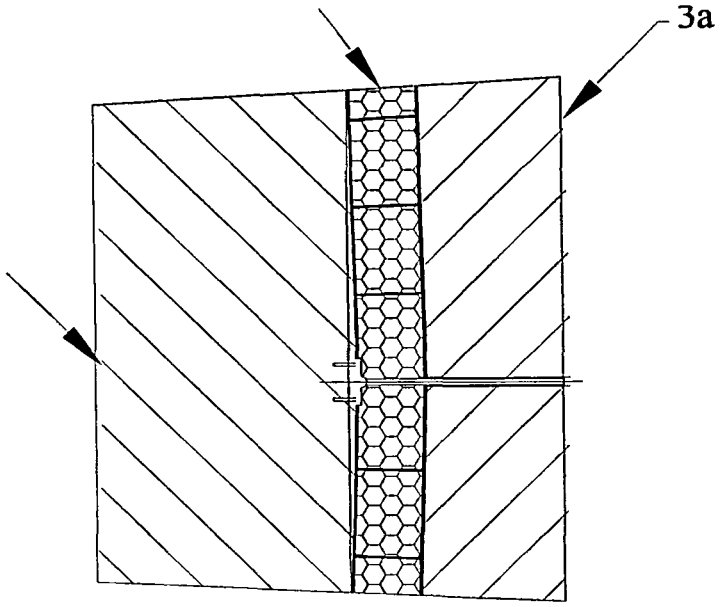
FIG. 5 is an enlarged view of circle II of FIG. 2.
Figure 6:
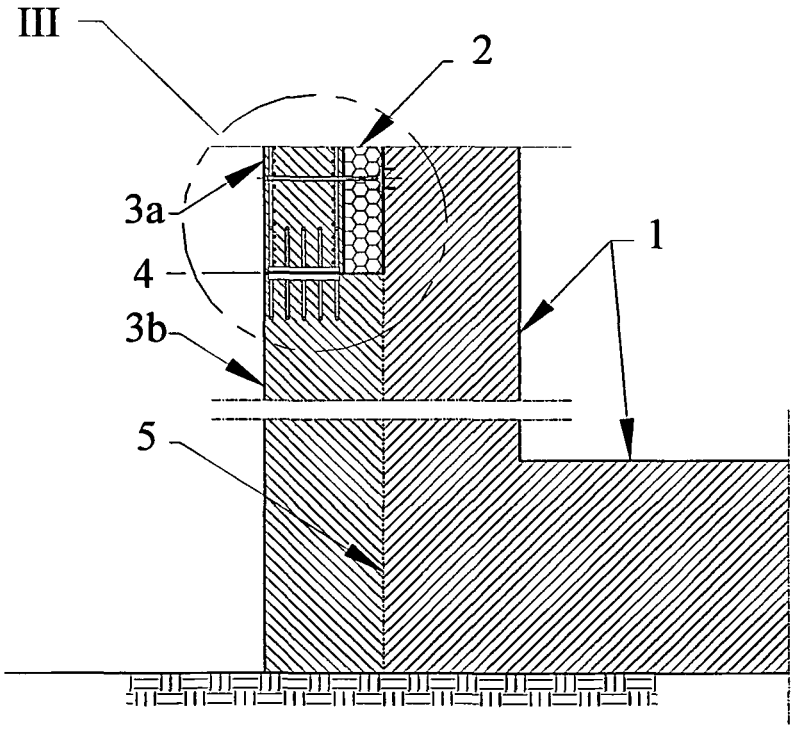
FIG. 6 is a partial cross-sectional view along the vertical axis of the main structure, showing the main components of the system, the sliding-plane; 3*b*, the fixed part of the outer shield and; 5, a construction joint between the main structure and the fixed part of the outer shield.
Figure 7:
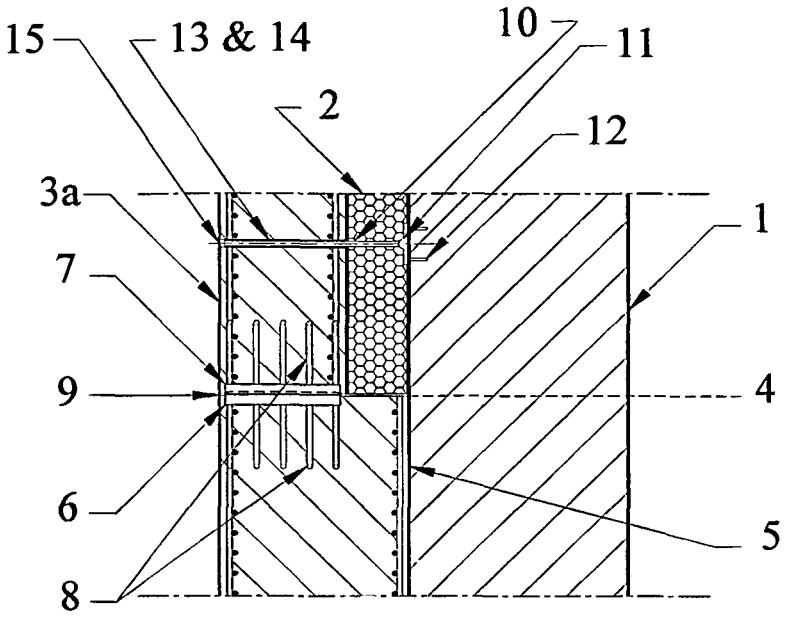
FIG. 7 is an enlarged view of circle III of FIG. 6. It shows the details at the sliding-plane, where 6 is a fixed plate; 7, a sliding plate; 8, anchor bolts for mounting the fixed and sliding plates to the fixed and movable parts of the outer shields, respectively; 9, a sealant to seal the gap between the fixed and movable parts of the outer shield from outside; 10, an anchor rod connecting the outer shield and the main structure; 11, a base plate for the anchor rod; 12, an anchor bolt fixing the base plate to the main structure; 13, a hole drilled through the outer shield; 14, an adhesive material filling the space between the anchor rod and the walls of the hole; and 15, a sealant to plug the hole of the outer shield from outside.
Figure 8:
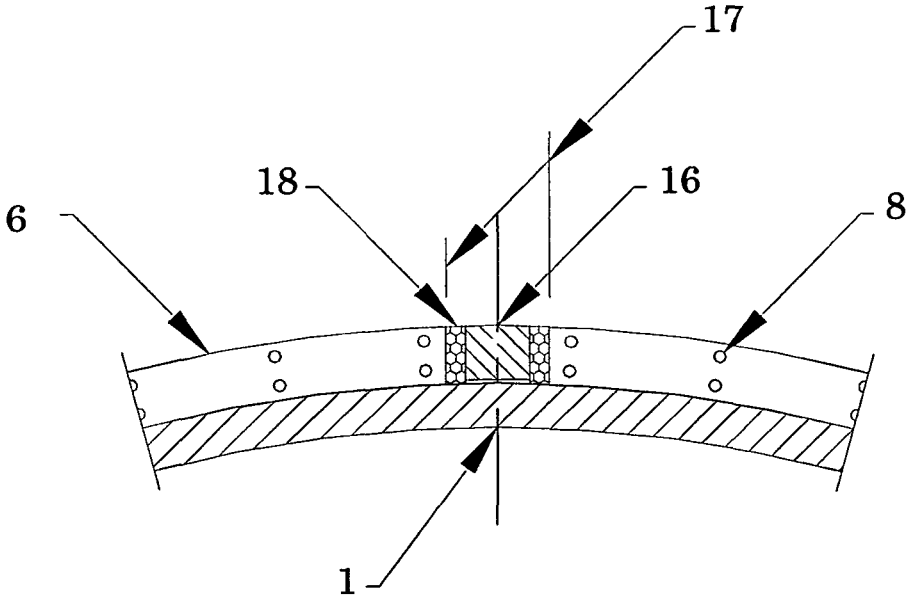
FIG. 8 is a partial cross-sectional view along the sliding-plane 4-4 of FIG. 1 in the direction of the arrows, where 16 is a key, which is a projection of the movable part of the outer shield; 17, two sides of a keyway which is a slot created into the fixed part of the outer shield in which the key is embedded and; 18, a crushable material filling the space between the key and the two sides of the keyway.
Figure 9:
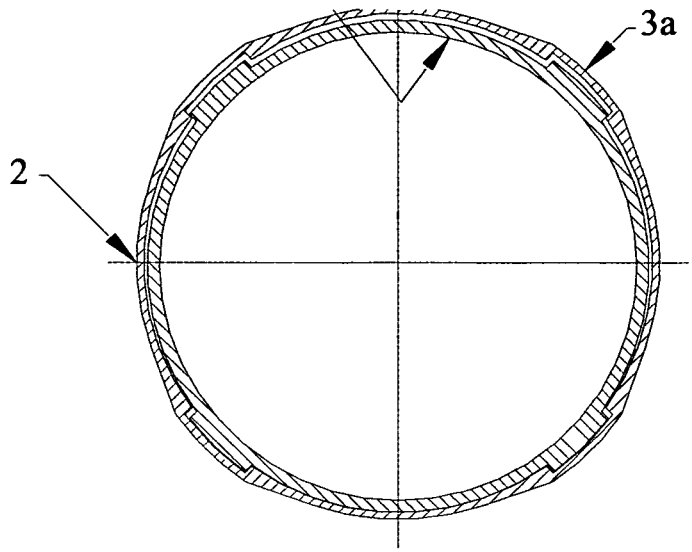
FIG. 9 is a cross-sectional view along line I-I of FIG. 1 showing the displaced outer shield due to an impactive or impulsive load.
Figure 10:
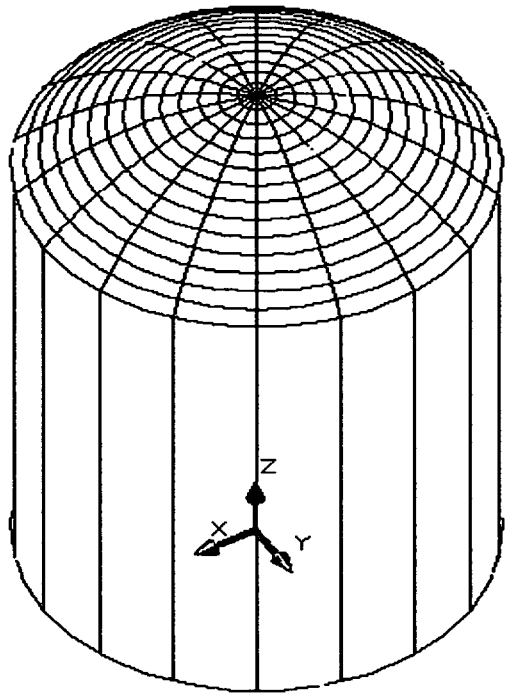
FIG. 10, shows the assumed location of a coordinate system used to explain the concept of this invention.

This system provides protection to the main structure 1, by having a movable outer shield 3*a* spaced apart from the main structure and a crushable filling layer 2 is filling the space in between. The high energy absorption capacity of this system is due in part to the ability of the outer shield to slide against a sliding-plane 4-4 crushing the filling layer. The outer shield has a fixed part 3*b*, which should be separated by a structural joint 5 from the main structure. This fixed part carries a fixed plate 6, which defines the sliding-plane. The movable part of the outer shield has a plate 7, which is provided with sliding means in order to allow the movable part of the outer shield to slide against the fixed plate. Both of the two plates are anchored to the outer shield by anchors 8. A sealant 9 is used to seal the outside gap between the two plates. The anchorage system could be designed in many different ways; one of them for example is to have rigid anchor rods 10 embedded at one end into holes 13 drilled through the outer shield, where the space between each bar and the walls of the hole in which it is embedded is filled with an adhesive material 14. The other end of each anchor rod is connected to a base plate 11 and the plate is mounted to the main structure by anchors 12. The holes are drilled through the outer shield at some selected locations and sealed from outside by a sealant 15 in order to protect the connections from humidity and other weather effects. Moreover, in order to resist the twisting movement which should result from an eccentric load, keys 16 and keyways 17 are created between the movable and the fixed parts of the outer shield with a relatively large clearance between the key and the sides of the keyway filled with a crushable material 18. A second way to make the connections of the anchorage system is to fix the movable part of the outer shield 3*a* to the fixed part 3*b* using vertical dowels, which should be sheared off at the impact. Assuming that the main structure is cylindrical in shape, and is located in a Cartesian space so that the Z axis coincides with the vertical axis of the structure as shown in FIG. 10, then a general impactive or impulsive load can be considered as the equivalent of the following six components: X, Y, Z, $M_x$, $M_y$ and $M_z$, where X, Y and Z are the force components in the directions of the X, Y, and Z axes, respectively and $M_x$, $M_y$ and $M_z$ are the moments about the X, Y, and Z axes, respectively. The Most damaging component to the structure is the force component that is in the radial direction normal to the vertical wall. This force is the resultant force of the X and Y components. In the current invention, this force is resisted as follows depending on its magnitude and area of application:

1. At a relatively small load, the outer shield should undergo a limited displacement crushing the filling layer locally at the area of the impact. Some of the connections of the anchorage system may fail as well.
2. At a higher level of loading, all the connections of the anchorage system should fail and the outer shield should undergo a free body motion sliding against the sliding-plane and crushing the filling material until the total energy of the load is absorbed or until the outer shield reaches the maximum possible displacement.
3. At the highest loading condition, the displaced outer shield, the compressed filling layer and the main structure should act as a structural system subjected to the effect of the remaining unabsorbed energy.

The vertical force component Z is resisted by the own weight of the shield if it is an uplifting force or by the reaction of the fixed plate if it is acting downward. The twisting moment $M_z$ is created mainly by the tangential friction and is resisted by the key-keyway interaction. Other moment components: $M_x$ and $M_y$ should have an overturning action, however, they are counteracted by the stabilizing moment which is due to the own weight of the shield. Moreover, the possibilities of overturning the shield by an impactive or an impulsive load are very remote since that requires the disintegration of the shield or the main structure itself.

There are two types of missiles: soft missiles and hard missiles. The type of missile is determined according to its relative rigidity comparing to the impacted structure. The effect of any of the two types of missiles upon a structure can be studied by analyzing the effect of the associated load-time function on the global stability of the structure. However, in case of a rigid missile, it is necessary to assess the possibilities of perforating the structure by the missile as well. As a hard missile hits a rigid structure, a very high impact force is generated for a very short period of time causing local damage to the structure at the location of the impact. This local damage, while does not undermine the integrity of the structure, however, it could result in serious consequences, in case—for example—a reservoir that contains flammable material or a nuclear reactor containment that is required to be airtight.

This structural system—with its hardened rigid outer shield—offers protection against both types of missiles. The protection against the effect of the load on the global stability of the structure was discussed earlier in this description, while the protection against the perforation risk was discussed in the invention summary.

It should be noticed that the relative strength of the different elements of this structural system should be observed in order to have the required performance under severe loading conditions. For instance, the anchorage system should be designed so that it collapses first before the outer shield is perforated by a representative missile. However, since there is a wide variety of loading conditions, then the design of this structural system should be optimized depending on the circumstances of each application.

One of the materials which could be utilized in making the filling crushable layer is the Stabilized Aluminum Foam (SAF), which has the following properties:

1. High energy absorption capacity.
2. Low heat conductivity.
3. Fire Resistance.
4. High soundproofing.
5. High damping capacity.
6. Environmentally safe.

The following is an explanatory example of designing a system that is capable of withstanding very high impactive load utilizing the Stabilized Aluminum Foam:

An elevated 18 m high cylindrical reservoir has an outside diameter of 40 m and contains highly flammable material. Due to the construction of a nearby airport, it was found that the reservoir is vulnerable to aircraft strikes. It is required to protect the reservoir so that it becomes capable of withstanding a normal impact of an aircraft landing at a speed of 300 km/h. The weight of the aircraft is assumed to be 250 tons and the estimated impact force is 244 MN.

Assuming that the structural system comprises of the following:

1. an outer shield made of reinforced concrete where both of its top cover and side walls are 2' thick and its total weight is 56 MN,
2. a crushable filling layer made of 18"thick Stabilized Aluminum Foam,
3. an anchorage system that consists of 48 dowels, each fail in shear if subjected to a shear force of 0.41 MN. Then:
   1. The kinetic energy of the aircraft=868 MJ
   2. Volume of SAF covering the impacted side=29.1×18=523.8 $m^3$
   3. Volume of the uncrushed SAF following a crash=10.4×18=187.2 $m^3$
   4. Volume of crushed SAF=523.8-187.2=336.6 $m^3$
   5. Energy absorbed in crushing the SAF=0.8 MJ/$m^3$×336.6 $m^3$=269 MJ
   6. Energy absorbed in moving the outer shield=56 MN×0.8×0.46 m=20.5 MJ
   7. Estimated energy absorbed in collapsing the anchorage system, keys, plastic deformations of the outer shield and friction=38.5 MJ
   8. Estimated energy absorbed in crushing the aircraft=540 MJ
   9. Total energy absorbed=868 MJ It should be noticed that the force generated by the impact is enough to crush the SAF and to slide the outer shield:

Impact force=244 MN

Force required to crush foam=40×18×0.30=216 MN

Force required to slide the outer ring=56 MN×0.15=8.4 MN

Force required to collapse the anchorage system=48×0.41 MN=19.6 MN

Total force required=216+8.4+19.6=244 MN

In this example, the first level of load resistance is defined by the capacity of the anchorage system which is 19.6 MN; the second level of load resistance is the range of loads between 19.6 and 244 MN, where the latter is the required load to displace the outer shield to the position of maximum displacement. The third level of load resistance is defined by loads higher than 244 MN.

In the previous example, the landing weight, the landing speed and the impact force of the aircraft are representative values for a jumbo jet. It was shown that the total kinetic energy of the aircraft could be absorbed in displacing the outer shield alone, which indicates that this structural system is capable of protecting the main structure against even higher impactive or impulsive loads.

Moreover, it should be noticed that following the impact, the displaced outer shield should exert additional moments on the main structure due to the eccentricity of the structure's own-weight in this case. This moment should increase the stresses at some locations; however, these additional stresses should not be significant due to the small ratio between the maximum displacement and the radius of the structure, which is in this example=0.36/20.0=0.018.

Furthermore, if the force required to displace the outer shield is very high due to the large surface area of the main structure, and consequently, the large surface area of the crushable layer, then it is possible to decrease this force by creating recesses in the crushable layer. The thickness of the foam at the recessed areas should be equal to the thickness of the main layer at the densification strain. For instance, the thickness of the crushable layer in the previous example is 0.46 m and the thickness of this layer at the densification strain is 0.09 m, then it is possible to decrease the thickness of the crushable layer to 0.09 m at several areas. This should result in decreasing the force required to displace the shield without undermining the function of the crushable layer.

An alternative mode for carrying out this invention that would be obvious to someone who is skilled in the art is the elimination of the crushable layer by having the gap between the main structure and the outer shield, substantially, as a void space. The feature of having a crushable layer filling the gap is a non-essential feature that is not indispensible for the function of the invention but it represents an addition to the function. Moreover, the removal of the crushable layer requires no real modification of other features to compensate for the change.

While particular embodiments of the invention have been disclosed, it is evident that many alternatives and modifications will be apparent to those skilled in the art in light of the forgoing description. Accordingly, it is intended to cover all such alternatives and modifications as fall within the spirit and broad scope of the appended claims.

The embodiments of the invention in which an exclusive property or privilege is claimed are defined as follows:

1. A structural system that is energy-absorbent and fire-resistant comprising:

a. a main structure having an at least one peripheral wall, b. an outer shield comprising:

i) a movable portion spaced apart from and surrounding a first portion of said at least one peripheral wall of said main structure and defining a gap therebetween, said movable portion having at least one sliding means to slide against a sliding-plane, ii) a fixed portion surrounding a second portion of said at least one peripheral wall of said main structure and supporting said movable portion and extending across a substantial portion of the width of said gap, said fixed portion having a fixed plate defining said sliding-planer; and c. an anchorage system comprised of: a plurality of anchors attached to said movable portion and at least one of said at least one peripheral wall and said fixed portion; wherein said anchorage system is configured to constrain said movable portion of said outer shield from moving and from rotating by initially fixing the movable portion; and wherein, during use, at least a portion of energy is absorbed by the deformation of the outer shield.

2. A structural system as claimed in claim 1, wherein said plurality of anchors comprising a plurality of dowels, said dowels are vertically positioned and disposed around said main structure, passing across said sliding-plane and anchoring said movable portion to said fixed portion of said outer shield.

3. A structural system as claimed in claim 1, wherein said plurality of anchors comprising:

a) a plurality of anchor rods, each of said anchor rods is mounted to said main structure and horizontally outwardly extending across said gap and nesting in a hole drilled-though said movable portion of said outer shield, b) an adhesive material bonding said anchor rod to the inner walls of said hole.

4. A structural system as claimed in claim 1, wherein said movable portion of said outer shield is provided with a plurality of keys, each of said keys is a projected element protruding across said sliding-plane and nesting in a keyway, said keyway is a cavity selectively dimensioned and located in said fixed portion of said outer shield, said keys and said keyways are hard-wearing elements which resist twisting moments.

5. A structural system as claimed in claim 1, wherein said movable portion of said outer shield is made of reinforced concrete.

6. A structural system as claimed in claim 1, wherein a crushable layer is filling said gap, said crushable layer is energy-absorbent and fire-resistant.

7. A structural system as claimed in claim 6, wherein said crushable layer is substantially made of stabilized aluminum foam.

8. A structural system as claimed in claim 6, wherein said crushable layer has a selectively reduced thickness at a plurality of recessed zones, where the total surface area of said recessed zones has a selected value.

* * * * *